US009310778B1

(12) United States Patent
Gancz

(10) Patent No.: US 9,310,778 B1
(45) Date of Patent: Apr. 12, 2016

(54) DOUBLED SIDED ALARM CLOCK

(71) Applicant: Asher Gancz, Brooklyn, NY (US)

(72) Inventor: Asher Gancz, Brooklyn, NY (US)

( * ) Notice: Subject to any disclaimer, the term of this patent is extended or adjusted under 35 U.S.C. 154(b) by 0 days.

(21) Appl. No.: 14/734,598

(22) Filed: Jun. 9, 2015

(51) Int. Cl.
*G04G 17/08* (2006.01)
*G04G 13/02* (2006.01)

(52) U.S. Cl.
CPC ..... *G04G 17/08* (2013.01); *G04G 13/02* (2013.01)

(58) Field of Classification Search
CPC ..... G04G 9/06; G04G 9/08; G04G 17/08; G04G 13/02; G04B 45/00
See application file for complete search history.

(56) References Cited

U.S. PATENT DOCUMENTS 2,996,875 A 8/1961 Graef
3,106,817 A 10/1963 Ducommun
5,305,290 A 4/1994 Yoo
6,069,848 A * 5/2000 McDonald ..... G04G 9/00 368/107
2006/0050616 A1* 3/2006 Brock ..... G04B 45/0076 368/10
2006/0082518 A1* 4/2006 Ram ..... G06F 1/1601 345/1.1
2006/0183505 A1* 8/2006 Willrich ..... G06F 1/1616 455/566
2008/0062625 A1* 3/2008 Batio ..... G06F 1/1615 361/679.29
2009/0231233 A1* 9/2009 Liberatore ..... G06F 1/1616 345/1.3
2011/0267929 A1* 11/2011 Ishakis ..... G04G 17/086 368/228

* cited by examiner

*Primary Examiner* — Sean Kayes
(74) *Attorney, Agent, or Firm* — Crossley & Stevenson IP Law

(57) ABSTRACT

A double sided alarm clock with a first panel and a second panel spaced apart from the first panel by a hinge. Each of the first panel and the second panel has a substantially rectilinear shape with a first end and a rectangular second end spaced apart from the first end. The hinge is disposed adjacent the first ends. A speaker is disposed within each panel. Each panel has a digital display screen, a plurality of controls, and a central processing unit, such that each panel is fully separately controlled. The central processing unit is in operational communication with the speaker, the display screen, and the plurality of controls. Each panel is fully and separately functional with settings and display screen, with the exception of a selectively shared power source.

1 Claim, 5 Drawing Sheets

DOUBLED SIDED ALARM CLOCK

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The desire for clocks with more than one face has been established, yet the few offered do not fulfill the needs of many consumers. For example, many share a bedroom, with perhaps a nightstand between two beds. Turning a clock to please one person results in displeasing another. What has been needed is a double sided digital clock that provides separate controls and separate clock viewing yet remains as one device. The present double sided alarm clock device fulfills this need.

FIELD OF THE INVENTION

The present double sided alarm clock relates to digital alarm clocks.

SUMMARY OF THE INVENTION

The general purpose of the double sided alarm clock, described subsequently in greater detail, is to provide a double sided alarm clock that has many novel features that result in a double sided alarm clock which is not anticipated, rendered obvious, suggested, or even implied by prior art, either alone or in combination thereof.

To accomplish this, the double sided alarm clock has a first panel and a second panel spaced apart from the first panel by a hinge. The first panel and the second panel are selectively provided in electronic operational communication configuration. Each of the first panel and the second panel has a substantially rectilinear shape having a rounded first end and a rectangular second end spaced apart from the rounded first end. The hinge is disposed adjacent the rounded first ends. The rounded ends provide best hinge function between the panels. Each of the first panel and the second panel has a front side and a back side spaced apart from the front side, and a top side and a bottom side spaced apart from the top side.

Each of the first panel and the second panel has a speaker, a digital display screen, a plurality of controls, a pair of rubberized feet, and a central processing unit (CPU). The speaker is disposed within the back side. The digital display screen is disposed within the front side. The plurality of controls is disposed on the top side. The controls comprise but are not limited to time set, date set, display screen settings, external media communication, and alarm set. The (CPU) is disposed within the panel. The CPU is in operational communication with the speaker, the display screen, and the plurality of controls.

A pair of rubberized feet is disposed on the bottom side of each of the panels. A power source is in communication with at least one panel. The power source is provided in both internal and external configuration.

Thus has been broadly outlined the more important features of the present double sided alarm clock so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
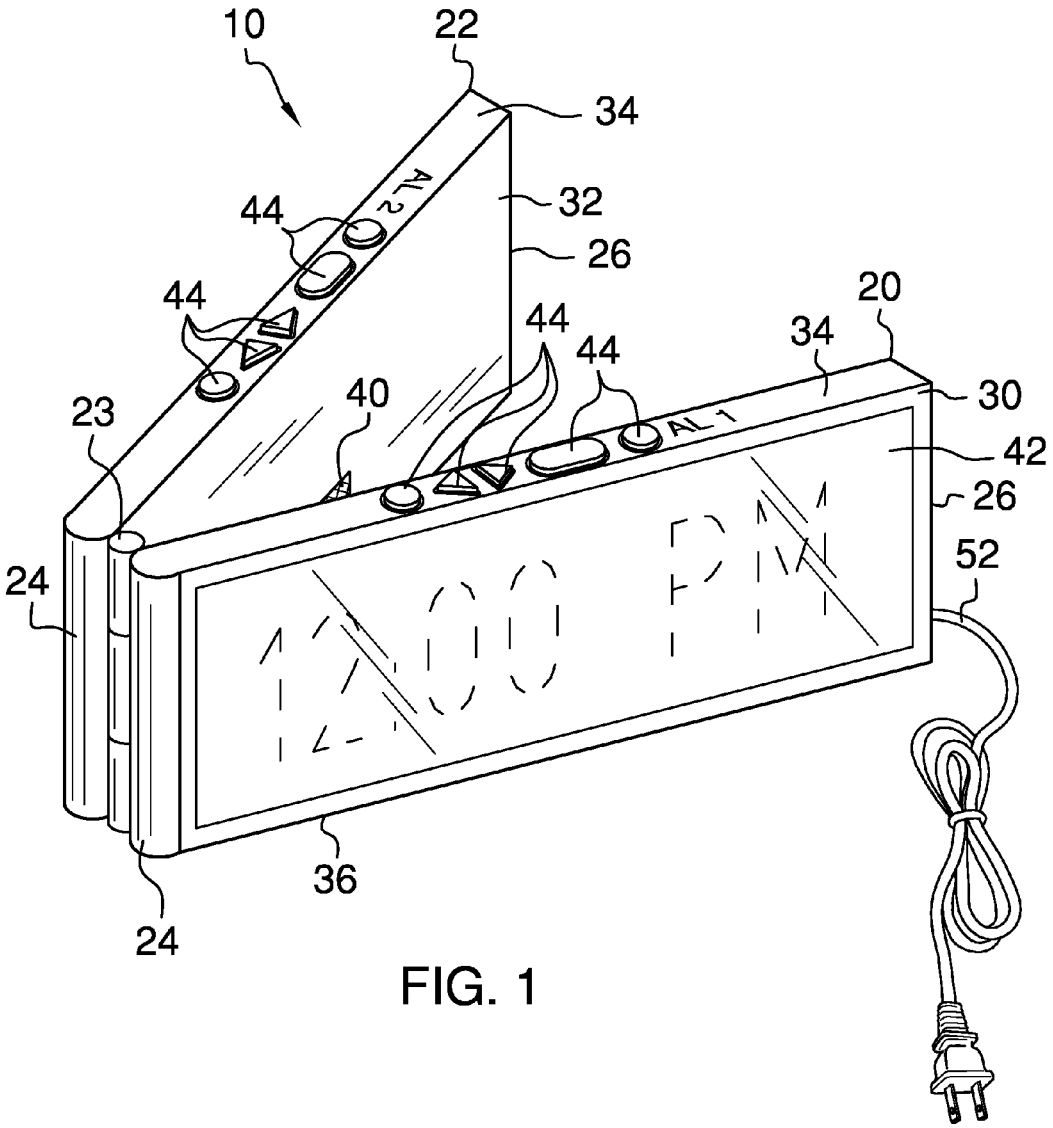
FIG. 1 is a first end perspective view.
Figure 2:
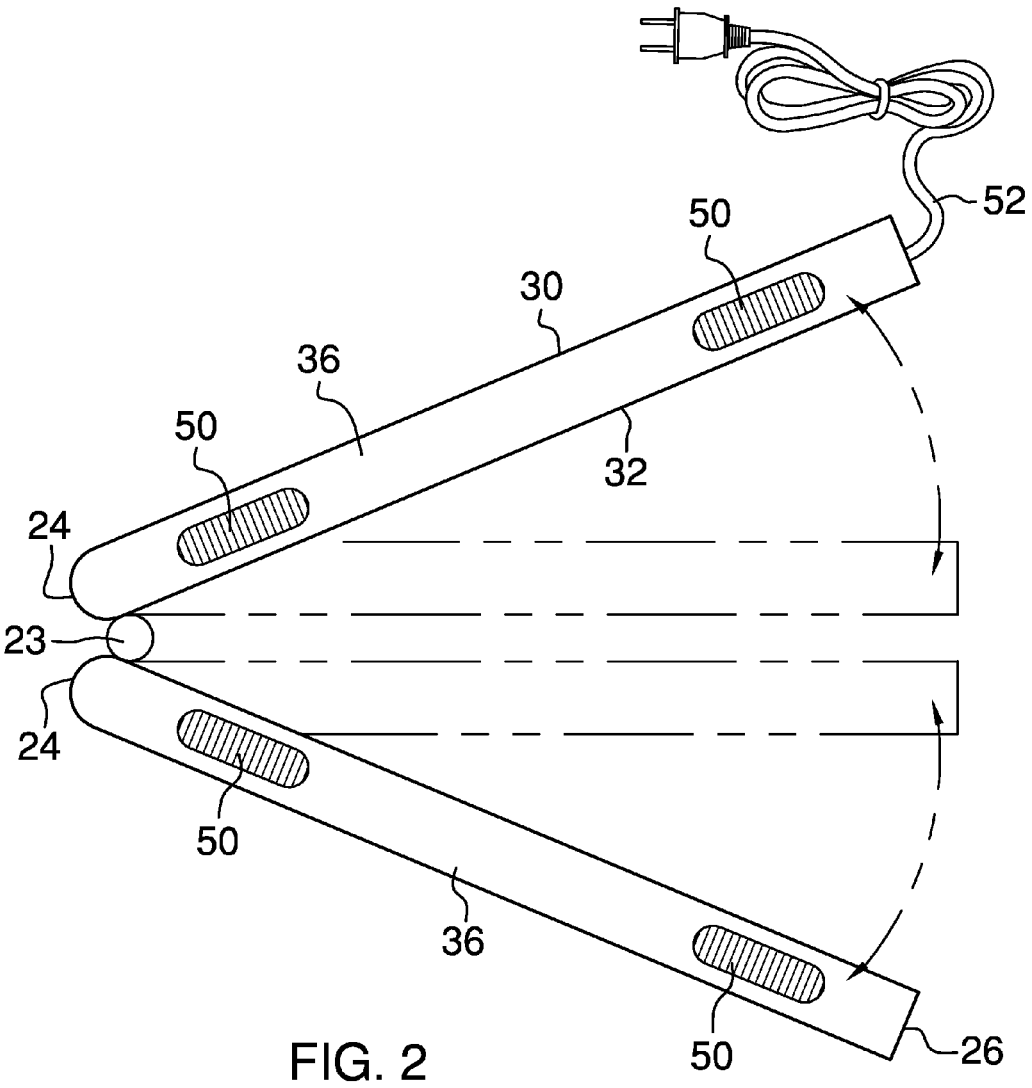
FIG. 2 is a bottom plan view.
Figure 3:
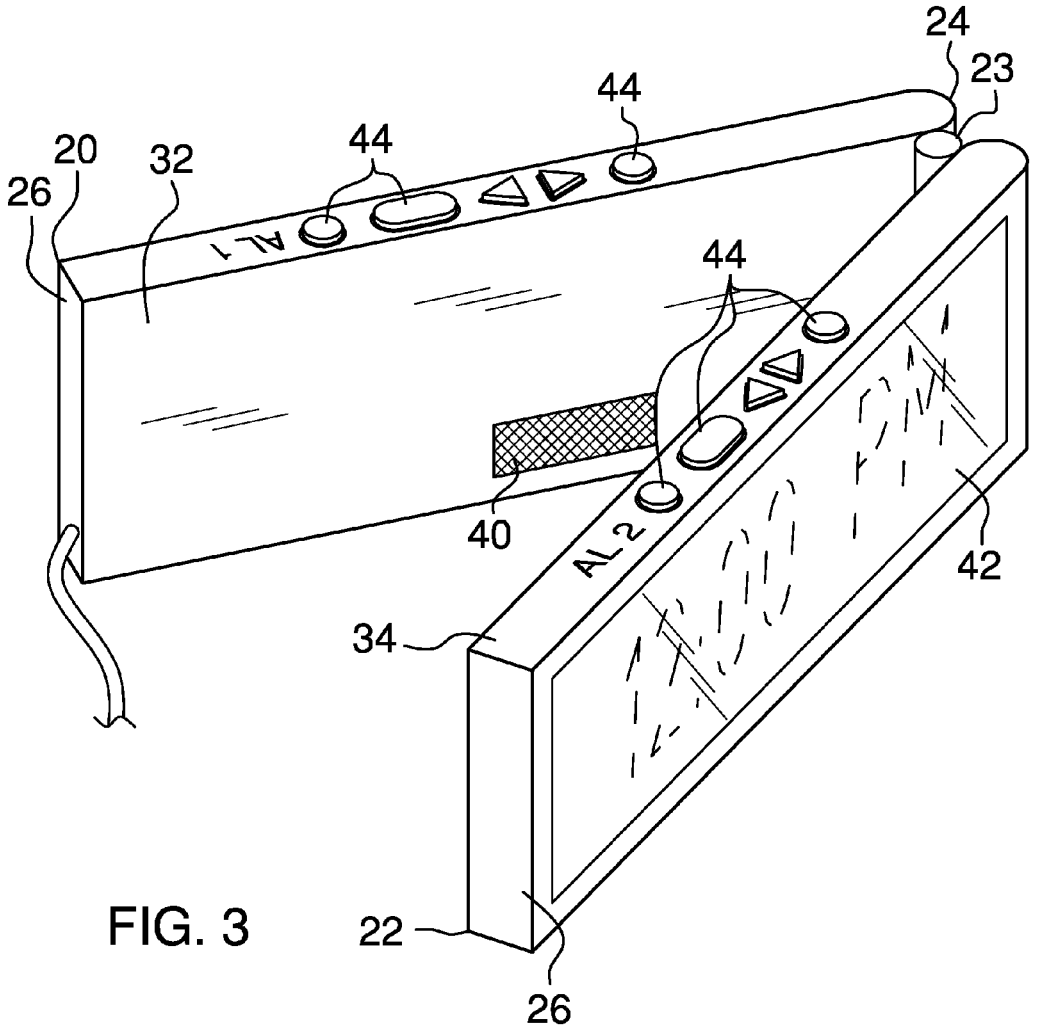
FIG. 3 is a second end perspective view.
Figure 4:
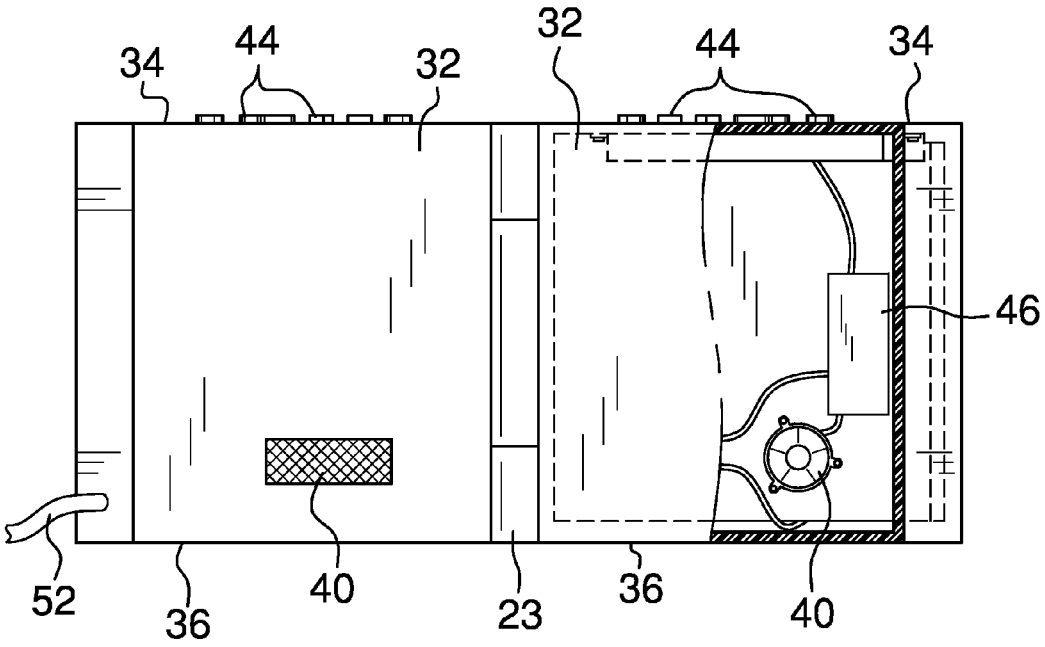
FIG. 4 is a back side cutaway view.
Figure 5:
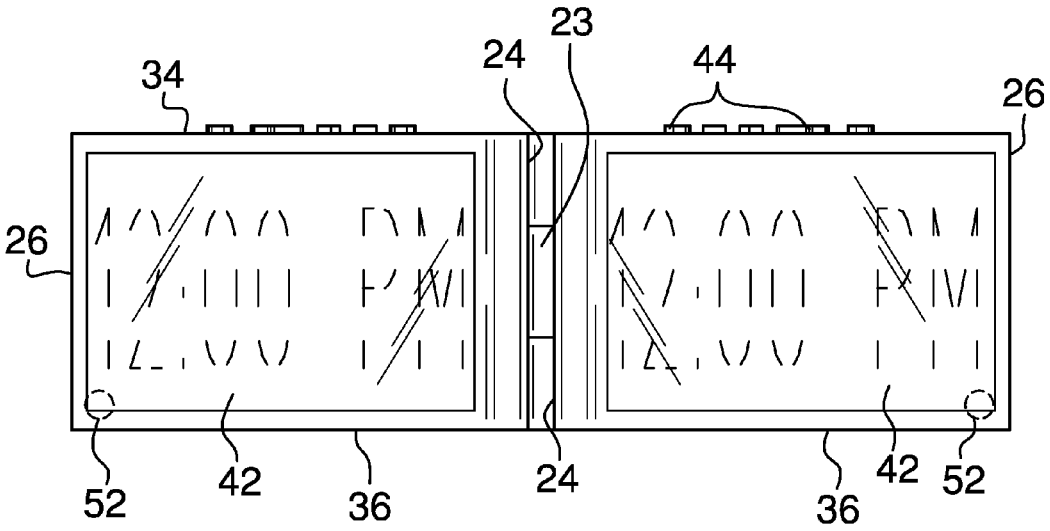
FIG. 5 is a front elevation view.

With reference now to the drawings, and in particular FIGS. 1 through 5 thereof, an example of the double sided alarm clock employing the principles and concepts of the present double sided alarm clock and generally designated by the reference number 10 will be described.

Referring to FIGS. 1 through 5, the double sided alarm clock 10 has a first panel 20 and a second panel 22 spaced apart from the first panel 22 by a hinge 23. The first panel 20 and the second panel 22 are in electronic operational communication. The first panel 20 and the second panel 22 are also provided as electronically stand alone panels 20, 22. Each of the first panel 20 and the second panel 22 has a substantially rectilinear shape having a rounded first end 24 and a rectangular second end 26 spaced apart from the rounded first end 24. Each of the first panel 20 and the second panel 22 has a front side 30 and a back side 32 spaced apart from the front side 30, and a top side 34 and a bottom side 36 spaced apart from the top side 34. The hinge 23 is disposed adjacent the rounded first ends 24.

Each of the first panel 20 and the second panel 22 has a speaker 40, a digital display screen 42, a plurality of controls 44, a pair of rubberized feet 50, and a central processing unit (CPU) 46. The speaker 40 is disposed within the back side 32. The digital display screen 42 is disposed within the front side 40. The plurality of controls 44 is disposed on the top side 34. The (CPU) 46 is disposed within the panel 20, 22. The CPU 46 is in operational communication with the speaker 40, the display screen 42, and the plurality of controls 44.

The pair of rubberized feet 50 is disposed on the bottom side 36 of each of the panels 20, 22. A power source 52 is disposed within at least one panel 20, 22. The power source 52 is provided both internally and externally. Each panel 20, 22 is fully and separately functional with settings, controls 44, CPU 46, and the display screen 42, with the exception of a selectively shared power source 52.

What is claimed is:

1. A double sided alarm clock comprising:

a first panel and a second panel spaced apart from the first panel, the first panel and the second panel in electronic operational communication, each of the first panel and the second panel having:

a substantially rectilinear shape having a rounded first end and a rectangular second end spaced apart from the rounded first end, a front side and a back side spaced apart from the front side, a top side and a bottom side spaced apart from the top side;

a speaker disposed within the back side;

a digital display screen disposed within the front side;

a plurality of controls disposed on the top side;

a central processing unit disposed within the panel, the central processing unit in operational communication with the speaker, the display screen, and the plurality of controls;

a pair of rubberized feet disposed on the bottom side;

a hinge joining the first panel to the second panel adjacent the first rounded ends; and a power source disposed within each of the first panel and the second panel;

wherein each of the first panel and the second panel is operationally independent.

* * * * *